US012152821B1

(12) United States Patent
Wang

(10) Patent No.: US 12,152,821 B1
(45) Date of Patent: Nov. 26, 2024

(54) COAXIAL PULSE TUBE CRYOCOOLERS

(71) Applicant: Chao Wang, Boxborough, MA (US)

(72) Inventor: Chao Wang, Boxborough, MA (US)

(73) Assignee: Boscryo LLC, Billerica, MA (US)

( * ) Notice: Subject to any disclaimer, the term of this patent is extended or adjusted under 35 U.S.C. 154(b) by 0 days.

(21) Appl. No.: 18/081,271

(22) Filed: Dec. 14, 2022

Related U.S. Application Data

(60) Provisional application No. 63/297,961, filed on Jan. 10, 2022.

(51) Int. Cl.
*F25B 9/10* (2006.01)
*F25B 9/14* (2006.01)

(52) U.S. Cl.
CPC ..... *F25B 9/145* (2013.01); *F25B 9/10* (2013.01); *F25B 2309/1406* (2013.01); *F25B 2309/1412* (2013.01); *F25B 2309/1415* (2013.01)

(58) Field of Classification Search
CPC ..... F25B 9/145; F25B 9/10; F25B 9/1415; F25B 9/1412; F25B 2309/1406
See application file for complete search history.

(56) References Cited

U.S. PATENT DOCUMENTS 5,107,683 A 4/1992 Chan et al.
5,295,355 A 3/1994 Zhou et al.
6,343,475 B1 * 2/2002 Ishikawa ..... F25B 9/145 62/6
6,378,312 B1 4/2002 Wang
8,418,479 B2 4/2013 Xu et al.

OTHER PUBLICATIONS

Haruyama, T., Kasami, K., Nishitani, T.; Experimental Study on Cooling Performance of a Coaxial Pulse Tube Cryocooler for a Liquid Xenon Detector; AIP Conference Proceedings 1218, 711 (2010); published Apr. 23, 2010; 10 pages.
Habibi, R., Thurk, M., Seidel, P.; Coaxial Pulse Tube Refrigerator for 4K; Crycoolers 17, pp. 197-202; 6 pages.
Haruyama, T., Kasami, K., Matsubara, Y., Nishitani, T., Maruno, Y., Giboni, K., and Aprile, E.; High-Power Pulse Tube Cryocooler for Liquid Xenon Particle Detectors; Cryocooler 13, pp. 689-694; 6 pages.
Shaowei, Zhu, Wu, Peiyi, and Zhongqi, Chen; Double Inlet Pulse Tube Refrigerators: An Important Improvement; Cryogenics, vol. 30, (1990), pp. 514-520; 6 pages.
Wang, Chao, Cai, Jinghuei, Cai, Zhou, Yuan, Wang, Suqing; Numerical Analysis and Experimental Verification of Multi-Bypass Pulse Tube Refrigerators; Advances in Cryogenic Engineering (1996), vol. 41B, pp. 1389-1394; 6 pages.

* cited by examiner

*Primary Examiner* — Nael N Babaa
(74) *Attorney, Agent, or Firm* — Barclay Damon LLP

(57) ABSTRACT

A two-stage pulse tube cryocooler, having compact size, less vibration and lower manufacturing cost is disclosed, in which at least a first stage of the cryocooler is coaxial, but in which first and second stages may be coaxial by locating circular regenerators of each stage inside of corresponding annular pulse tubes. A second stage circular regenerator is installed below a first stage regenerator. This configuration allows preassembly of the regenerator assembly and a base tube assembly in one or more stages. The pulse tube, which is annular, is coaxially formed with an outside surface of the assembled regenerator assembly and an inner surface of the outer tube of the base tube assembly after installation of the regenerator assembly.

12 Claims, 13 Drawing Sheets

COAXIAL PULSE TUBE CRYOCOOLERS

CROSS REFERENCE TO RELATED APPLICATION

This application claims priority to U.S. Application Ser. No. 63/297,961, entitled: COAXIAL PULSE TUBE CRYOCOOLERS, filed Jan. 10, 2022, under relevant portions of 35 U.S.C. § 119 and 35 U.S.C. § 120. The entire contents of the referenced application is incorporated herein by reference.

BACKGROUND OF THE INVENTION

Field of the Invention

This application generally pertains to the field of cryogenic refrigeration. More particularly, the application pertains to pulse tube cryocoolers, which have concentric configurations for regenerators and pulse tubes.

Description of Related Art

A pulse tube (PT) cryocooler is a cryogenic refrigeration device without cryogenic moving parts, when compared to the traditional Gifford-McMahon (GM) cryocooler and Stirling cryocooler. A PT cryocooler has higher reliability, experiences less vibration and a longer maintenance interval. A two-stage PT cryocooler can operate at a temperature range from 2° K to 25° K for cooling low temperature devices, such as medical Magnetic Resonance Imaging (hereinafter "MRI"), cryogenic sensors and cryopumps, among others.

A typical PT cryocooler mainly consists of a pressure wave generator configured to supply periodically oscillating gas pressure and an expansion device (commonly and hereinafter referred to as a "cold head" or "PT cold head") to achieve cryogenic temperatures. The pressure wave generator can be a valveless compressor for a Stirling-type cryocooler to generate periodically oscillating pressure, or a valved compressor for a GM-type cryocooler with a switching valve to chop the constant high/low pressure into periodically oscillating pressure.

A single-stage PT cold head consists of a pulse tube (expansion part), a regenerator, two heat exchangers with a single heat exchanger being disposed at the cold and the warm end of the pulse tube, respectively, and a phase shifter. The pulse tube, which is made from a low thermal conductive tube, e.g., stainless steel tube, is essentially an adiabatic space wherein the temperature of the working fluid is stratified, such that one end of the pulse tube is warmer than the other end. A PT cryocooler operates by cyclically compressing and expanding a refrigerant gas, such as helium, inside of the pulse tube in conjunction with movement of the refrigerant through the heat exchangers. Heat is removed from the cold end of the pulse tube to the room temperature end thereof upon expansion of the refrigerant.

A regenerator is made of, for example, a varied number of fine mesh screens or particles with high specific heat properties which are packed in a regenerator housing, wherein the regenerator performs as a thermodynamic sponge, alternatively releasing and absorbing heat in a cycle. A cold heat exchanger at the cold end of the pulse tube produces the cooling power when the expansion refrigerant gas passes through it. A warm heat exchanger at the warm end of the pulse tube releases heat to the environment when the hot gas flows through it. Both heat exchangers also perform as flow straighteners relative to the pulse tube. A phase shifter disposed at the outlet of the warm heat exchanger is used to control the phase of the mass flow and pressure in the pulse tube for the best cooling performance.

FIG. 1 shows a schematic of a conventional two-stage PT cold head, which is used for literally all current commercial products, and most developments. Applicant introduced the configuration in U.S. Pat. No. 6,378,312 B1, and some of his research papers. The conventional two-stage PT cold head is defined by a substantially U-type configuration in which a first stage regenerator 103, including a regenerator housing 103A and regenerative materials 103B, is positioned in parallel to a first stage pulse tube 115, the latter consisting of a tube 115A and an empty space 115B. A second stage regenerator 107, including a regenerator housing 107A and regenerative materials 107B, is disposed in parallel with a second stage pulse tube 113, the latter consisting of a tube 113A and an empty space 113B. A gas flow channel 112 connects the first stage regenerator 103 to a cold heat exchanger 105 located at the cold end of the first stage pulse tube 115. The cold heat exchanger 105 thermally contacts a first stage cooling station 106 for providing first stage cooling. Another flow channel 110 connects the second stage regenerator 107 to a second stage cold heat exchanger 111. The second stage cold heat exchanger 111 thermally contacts a second stage cooling station 109 for providing second stage cooling. A pressure wave generator schematically shown as 21 supplies a periodically oscillating flow to the inlet of the first stage regenerator 103. In a high-pressure period, refrigerant gas flows through the first stage regenerator 103 and then is divided into separate flow streams. One flow stream passes through the gas flow channel 112 into the first stage pulse tube 115. Another flow stream continuously flows into the second stage regenerator 107 and then into the second stage pulse tube 113 through the flow channel 110. In a low-pressure period, the flows are just reversed in which refrigerant gas expansions in the pulse tubes 113, 115 generate cooling capacities on the first stage heat exchanger 105 and the second stage heat exchanger 111. A first stage phase shifter schematically shown as 22 and a second stage phase shifter schematically shown as 23 are connected at the warm end heat exchangers 101 and 117, respectively, for achieving the desired mass flow/pressure-phase relationship in the pulse tubes 113 and 115 needed for refrigeration. A base plate 102 is used to enable cold head installation on a cryostat (not shown). The cooling performance of this configuration is effective, but the cold head structure is complicated and the U-turn gas flow can generate horizontal vibrations.

Other than the U-type configuration, a PT cold head or cold head assembly can employ two more configurations, namely the in-line type and the coaxial type. The in-line type of PT cold head for a two-stage pulse tube cryocooler was described in U.S. Pat. No. 5,107,683. In this configuration, the pulse tube and the regenerator are connected in serial. The heat pumped from the first and second stage pulse tubes is rejected to a room temperature heat sink. The in-line configuration has cooling stations disposed in the middle of the cold head and is not user friendly for commercial products.

A coaxial two-stage PT cold head shown in FIG. 2 was described by R. Habibi et. al. in a paper of "Coaxial Pulse Tube Refrigerator for 4K", *Cryocooler* 17. pp. 197-202, and also is described in U.S. Pat. No. 8,418,479. In the coaxial configuration, a second stage pulse tube 213, containing a tube 213A and an empty space 213B, is located partially inside of a second stage annular regenerator 208 and partially inside of a first stage annular pulse tube 215. A room temperature heat exchanger 217 and a second stage cold heat exchanger 211 are located at opposing ends of the second stage pulse tube 213, respectively. The first stage annular pulse tube 215 is formed by the inner surface of the first stage tube 216 and the outer surface of the tube 213A. A first stage annular regenerator 204 is located between the first stage tubes 203 and 216. A first stage annular room temperature heat exchanger 201 and a first stage annular cold heat exchanger 205 are installed at opposing ends of the first stage annular pulse tube 215. The first stage cold heat exchanger 205 thermally contacts a first stage cooling station 206 for providing first stage cooling. A flow channel 212 connects the cold end of the first stage regenerator 204 to the first stage cold heat exchanger 205 and the warm end of the second stage regenerator 208.

The second stage annular regenerator 208 is located between the second stage tube 207 and the second stage tube 213A. A flow channel 210 connects the second stage regenerator 208 to the second stage cold heat exchanger 211. The second stage cold heat exchanger 211 thermally contacts a second stage cooling station 209 to provide second stage cooling. A base plate 202 is used to enable cold head installation to a cryostat (not shown). There are radial heat transfers among the multiple coaxial components of the regenerators and pulse tubes due to different temperature gradients for each component. This results in a reduction of the cooling performance. The cold head according to this configuration is very costly to build given the use of annular regenerators.

A coaxial multi-bypass pulse tube cryocooler was introduced as described in U.S. Pat. No. 5,295,355 to lower the achievable temperature of the cryocooler. The concentric configuration described by this patent has a circular pulse tube located inside of the annular regenerator and a controllable middle-bypass flow between the pulse tube and the regenerator. An annular regenerator is formed by the outside surface of the pulse tube and the inner surface of the outer regenerator tube. The middle-bypass PT cold head was suggested to lower the achievable temperature. There is no heat exchanger at the middle-bypass location, so that this middle-bypass PT cryocooler merely performs as a single stage cryocooler.

T. Haruyama et al presented a coaxial single-stage PT cryocooler by locating a circular regenerator inside of an annular pulse tube, as described in "High-Power Pulse Tube Cryocooler for Liquid Xenon Particle Detectors", Cryocooler 13, pp. 689-694; and "Experimental Study on Cooling Performance of a Coaxial Pulse Tube Cryocooler for a Liquid Xenon Detector", AIP Conference Proceedings 1218, 711 (2010). FIG. 3 shows a schematic of this coaxial PT cold head. Regenerative materials 44 are packed in a regenerator tube 43. The outer surface of the regenerator tube 43 and an inner surface of tube 49 form a space for an annular pulse tube 48. The cold portion of the regenerator housing 43 is placed surrounding the cold heat exchanger 53 (a group of slots), which is part of a bottom cooling station 46. A room temperature heat exchanger 41 and a flow straightener 45 are installed on respective ends of the annular pulse tube 48. One end of the heat exchanger 41 connects to a phase shifter, shown schematically as 24. A flow channel 47 connects the heat exchanger 53 to the flow straightener 45. An inlet plug 50, which is connected to a pressure wave generator 21, is placed inside of the regenerator tube 43. Two flow distributers 51 and 52 are placed at opposing ends of the regenerator materials 44. A base plate 42 is used to enable cold head installation. This configuration allows use of the circular regenerator in the coaxial design. The cold head according to this configuration could eliminate horizonal vibrations. However, this configuration has not been accepted or used by others in terms of research or in commercial products due to concerns of construction. The regenerator tube 43 in this configuration has open ends and no enclosure to hold the regenerator materials for removal as a unit. In addition, this configuration relies on the bottom cooling station 46 and the inlet plug 50 to hold the regenerator materials in place. Moreover, it is obvious from their drawings that the regenerator is not pre-assembled outside for installation or removal.

One objective of the present teaching is to provide efficient coaxial configurations of two-stage PT cryocoolers with compact size, less complexity and vibration and easier to construct than prior configurations of PT cryocoolers.

A further objective of the present teaching is to provide methods for reducing system manufacturing cost and service cost.

SUMMARY OF THE INVENTION

Prior coaxial two-stage PT cold heads have their circular pulse tubes located inside of the annular regenerators. Accordingly, it is very difficult to assemble the first and second stage annular regenerators. The present teaching discloses two-stage PT cryocoolers having at least a coaxial first stage of PT cold head by locating a first stage circular regenerator inside of a first stage annular pulse tube and a second stage circular regenerator installed in line and below the first stage regenerator. The first stage annular pulse tube space is formed with the outer surface of the first stage circular regenerator and the inner surface of the first stage annular pulse tube, i.e., the base tube. In certain embodiments, a base tube assembly may have enough space to install the second stage circular regenerator.

The present teaching also discloses a novel method to pre-assemble a regenerator assembly and a base tube assembly. In certain embodiments, an annular pulse tube space may be formed with the outer surface of the regenerator assembly (after installing the regenerator assembly in the base tube assembly) and the inner surface of the outer tube of the base tube assembly. The assembling method can reduce the number of components used in the PT cold head, as well as reduce the manufacturing cost and service cost.

In certain embodiments of the presently taught coaxial configuration, two-stage PT cold heads or cold head assemblies may be built compactly by locating the first stage circular regenerator in the first stage annular pulse tube and locating a second stage circular regenerator in the second stage annular pulse tube below and in line with the first stage.

In other embodiments, the present teaching may be used to construct hybrid two-stage pulse tube cold heads made up of a coaxial first stage and a U-type second stage.

In other embodiments, the present teaching of the assembling method may also be applied to coaxial single-stage PT cold heads with a pre-assembled removable circular regenerator assembly.

These and other features will be readily apparent from the following Detailed Description, which should be read in conjunction with the accompanying drawings.

DETAILED DESCRIPTION OF THE INVENTION

The present teaching is related to two-stage PT cryocoolers in which at least the first stage uses a coaxial configuration by locating a regenerator assembly having a circular cross section inside of the annular pulse tube. The outer surface of the regenerator assembly and the inner surface of an outer tube form an annular space defining the pulse tube. With this coaxial configuration, the regenerator assembly may be pre-assembled with end caps on both ends to hold the regenerator materials, and installed and removed freely. The opening space of the tube before installing the first stage regenerator assembly may be large enough to install the second stage circular regenerator below in certain embodiments. The present teaching can be applied to coaxial two-stage PT cryocoolers or hybrid two-stage PT cryocoolers having a coaxial first stage and a U-type second stage. Higher stages (e.g., three-stage, etc.) with the same coaxial designs are also possible. The assembling method for the coaxial cold head described herein may also be applied to a single-stage coaxial PT cold head, as well.

Descriptions of the present teaching are given below, with reference to FIGS. 4-13.

Figure 4:
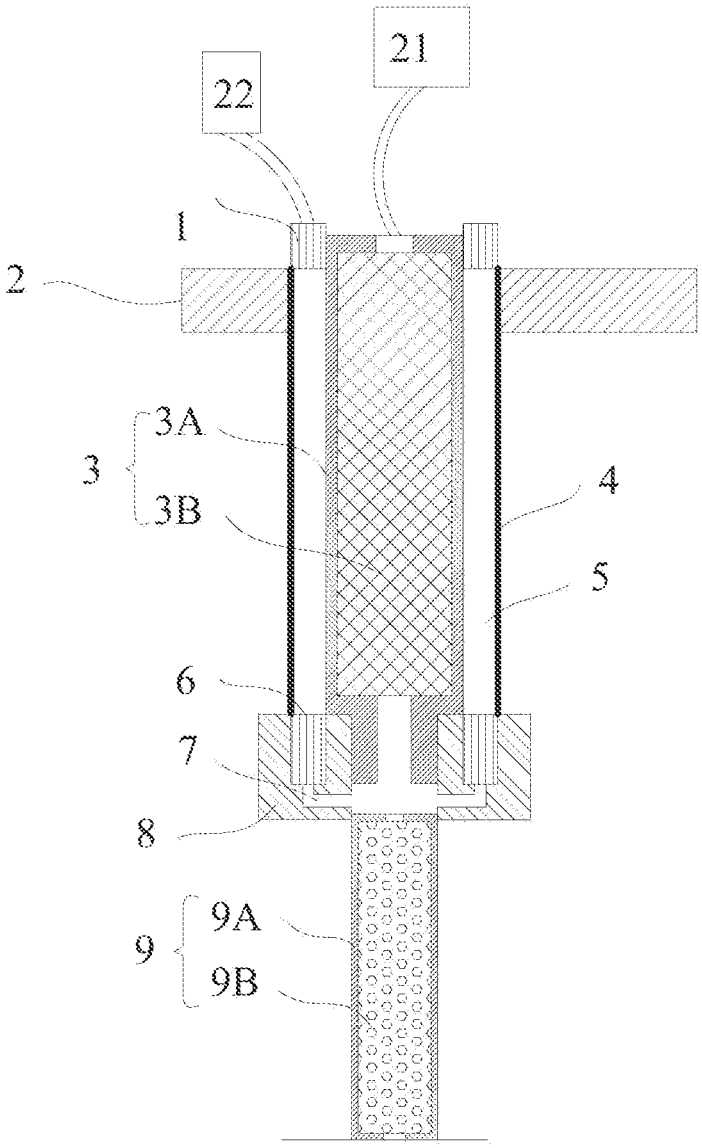
FIG. 4 shows a schematic of an exemplary two-stage coaxial assembly of a PT cold head having a coaxial first stage circular regenerator, a first stage annular pulse tube, and a second stage circular regenerator, in accordance with an embodiment of the present teaching. The second stage circular regenerator may be installed below and in line with the first stage regenerator.

First, FIG. 4 depicts an exemplary two-stage coaxial assembly of a PT cold head or cold head assembly comprising a coaxial first stage regenerator 3 having a circular configuration, an annular hollow pulse tube 5, and a second stage circular regenerator 9, in accordance with an embodiment of the present teaching. According to this embodiment, the first stage regenerator assembly 3 (also referred to throughout as "regenerator", based on its intended function), including a cylindrical regenerator housing 3A and various regenerative materials 3B contained in the regenerator housing 3A, is located in the center of the outer tube 4. The outside surface of the regenerator assembly 3 and an inner surface of the outer tube 4 form an annular space 5 for the first stage pulse tube. The wall of the first stage regenerator housing 3A may be made from low thermally conductive materials, such as stainless steel, non-metallic materials, etc., to reduce the radial heat transfer loss through the wall and axial heat conduction loss along the wall of the cylindrical regenerator housing 3A. The wall of the regenerator housing 3A may also be made of two-layer low thermally conductive materials, e.g., stainless steel for an outer layer of the housing 3A and non-metallic materials for an inner layer. The regenerator assembly 3 may be densely packed with regenerative materials 3B, which may include, but is not limited to stainless-steel screens or phosphor bronze screens, spheres, etc. It should be noted that the regenerative materials 3B may include different combinations of screens, spheres, etc.

A flow channel 7 interconnects the first stage regenerator assembly 3 to a first stage cold heat exchanger 6. The cold heat exchanger 6 thermally contacts with a first stage cooling station 8 to provide first stage cooling.

The center axis of an adjacent second stage regenerator 9 may be in line with the center axis of the first stage regenerator assembly 3 or may be slightly offset therefrom in certain embodiments. The hollow space of the outer tube 4 in FIG. 4 before installing the first stage regenerator assembly 3 may be large enough to install the second stage circular regenerator assembly 9 below the first stage through the first stage outer tube 4 in certain embodiments. In this case, the offset distance if exists should be small that the second stage circular regenerator 9 can pass through the hollow space of the first stage outer tube 4 for the installation. A base plate 2 at the opposing end of the first stage regenerator assembly 3 is used to enable cold head installation on a cryostat (not shown).

A first stage annular cold flow straightener/heat exchanger 6 and a warm flow straightener/heat exchanger 1 are located at the cold and warm ends of the annular pulse tube 5, respectively, as shown in FIG. 4. In one embodiment, the component 6 can merely be a flow straightener, and not a heat exchanger. In this instance, a first stage cold head heat exchanger can be installed below the first stage regenerator assembly 3. One end of the heat exchanger 1 connects to a phase shifter shown schematically as 22.

Figure 5:
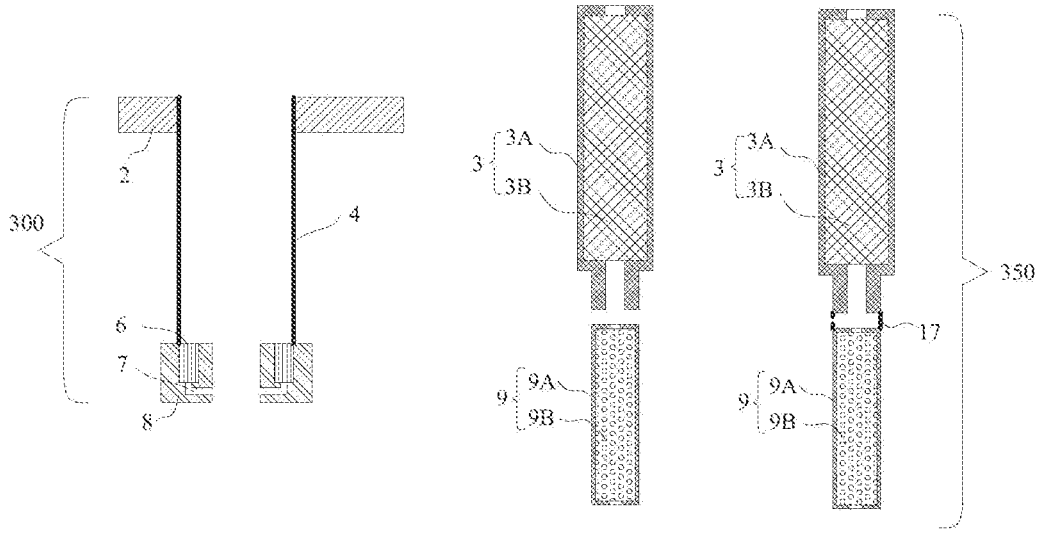
FIG. 5 shows schematics of exemplary subassemblies of a base tube assembly and separate first and second stage regenerator assemblies of the embodiment in FIG. 4, and the connected regenerator assemblies.

In accordance with certain embodiments of the present teaching, an exploded view of the two-stage coaxial assembly of the PT cold head in FIG. 5 illustrates exemplary assembling methods with sub-assemblies: namely, a base tube assembly 300, which may include a base plate 2, the outer tube 4, the cold heat exchanger 6, the flow channel 7 and the first stage cooling station 8, a second stage regenerator assembly 9, and a first stage regenerator assembly 3. The first stage regenerator assembly 3 may be pre-assembled by packing the regenerative materials 3B into the cylindrical regenerator housing 3A. The second stage regenerator assembly 9 may be pre-assembled by packing the regenerative materials 9B into the regenerator housing 9A. The first stage and second stage regenerator assemblies 3 and 9 may be kept separate or connected together using a linkage 17 as a regenerator unit 350. The linkage 17 can be any connector or other suitable coupling means designed to connect the regenerator assemblies together.

Figure 6:
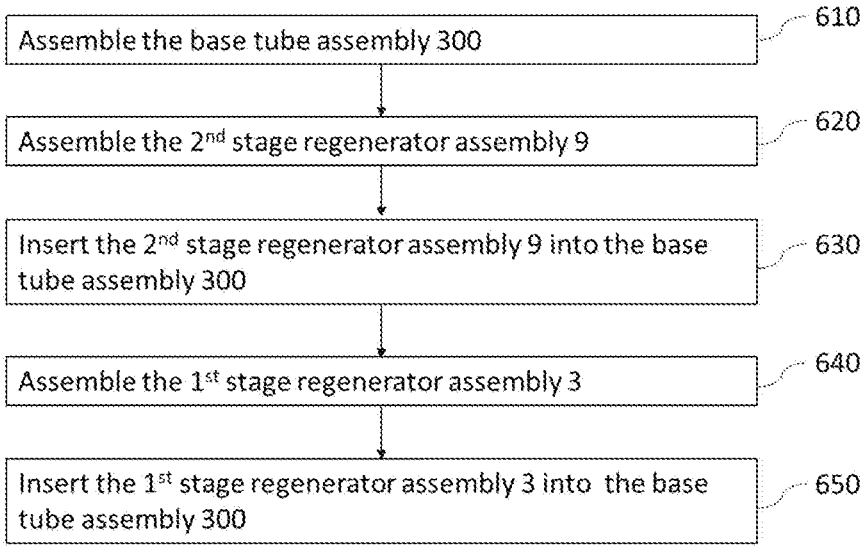
FIG. 6 shows an exemplary diagram of assembling the two-stage coaxial assembly of a PT cold head in accordance with the assembly of FIG. 4.

One exemplary assembling process of the two-stage PT cold head assembly is depicted in FIG. 6. According to this process, the base tube assembly 300 may be first assembled at step 610. The second stage regenerator assembly 9 may then be assembled at step 620 and inserted into the base tube assembly 300 at step 630. The first stage regenerator assembly 3 may be assembled at step 640 and inserted into the base tube assembly at step 650. After the installation of the first stage regenerator assembly 3, the outside surface of the first stage regenerator assembly 3 and the inner surface of the outer tube 4 form the annular space for the first stage pulse tube 5. In certain embodiments, step 620 and/or 640 may occur before any other steps in FIG. 6.

An alternative assembling process is illustrated in FIG. 5. According to this process, the first and second stage regenerator assemblies 3 and 9 may be connected using a linkage 17 as the regenerator unit 350 and then the regenerator unit 350 can be inserted into the base tube assembly 300. As noted previously, the linkage 17 can be any component designed to hold the two regenerator assemblies 3 and 9 together or a connecting mechanism (such as threads) on the two regenerator assemblies 3 and 9 for connecting the assemblies together. The present teaching reduces the number of components in the cold head, and simplifies the assembling process, thereby reducing the manufacturing cost.

Figure 7:
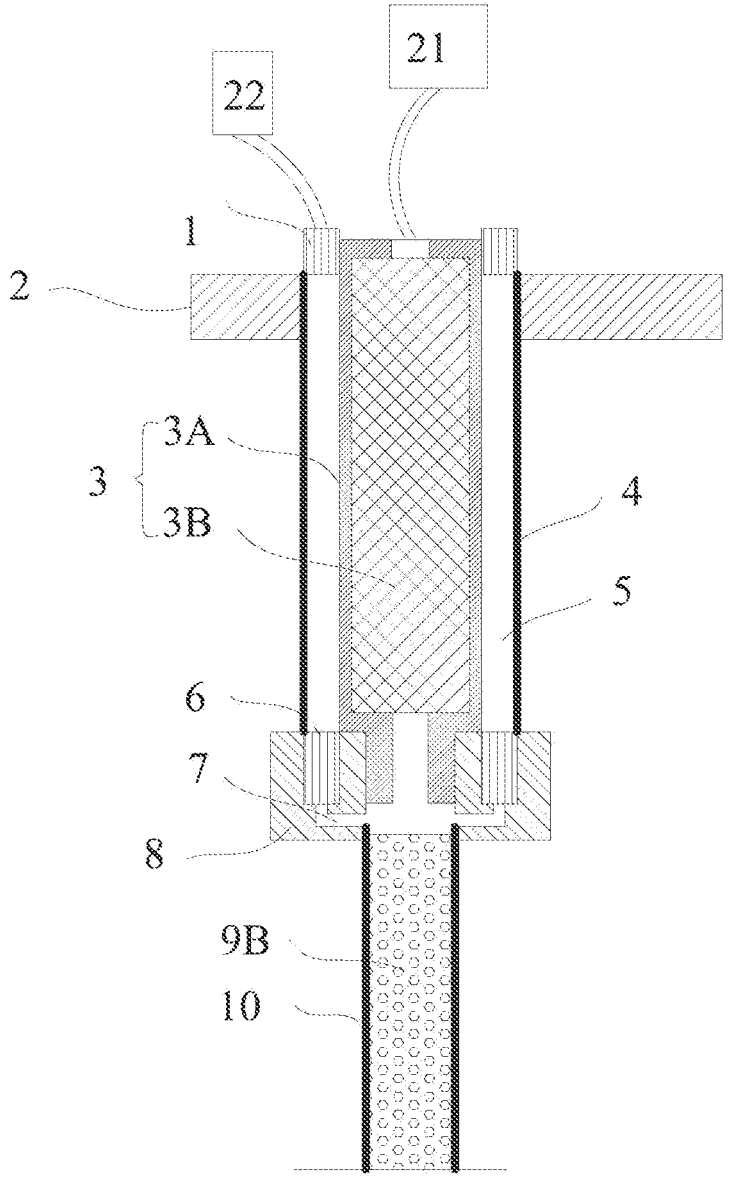
FIG. 7 shows a schematic of an exemplary two-stage coaxial assembly of a PT cold head with a second stage regenerator tube in accordance with another embodiment of the present teaching.

A variation of the embodiment depicted in FIG. 4 is shown in FIG. 7, which illustrates an exemplary two-stage PT assembly with a second stage regenerator tube 10 in accordance with an embodiment of the present teaching. In this embodiment, like numbers refer to like parts for the sake of convenience. The second stage regenerator tube 10, which according to this embodiment is not removable, may be constructed together with a first stage cooling station 8, or joined by soldering, welding, brazing, or other suitable joining techniques. The second stage regenerator tube 10 may perform as the regenerator housing in order to directly contain the regenerative materials 9B. In a variation of this embodiment, the second stage regenerator assembly 9, comprising the regenerator housing 9A which according to the invention is preferably cylindrical and various regenerative materials 9B, may be inserted into the second stage regenerator tube 10 in lieu of the packed regenerative materials.

Figure 8:
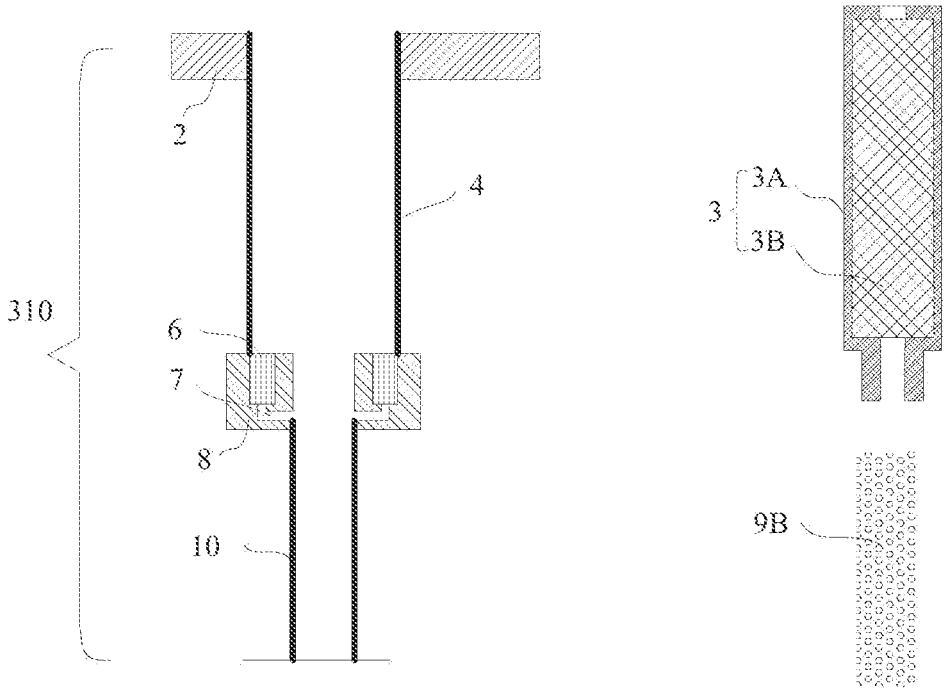
FIG. 8 shows schematics of exemplary subassemblies of a base tube assembly including a second stage regenerator tube housing second stage regenerator materials directly and the first stage regenerator assembly of the embodiment of FIG. 7.

An exploded view of the exemplary two-stage PT assembly with the second stage regenerator tube 10 of the embodiment in FIG. 7 is shown in FIG. 8. The assembling process of this embodiment is: (1) assembling the base tube assembly 310: (2) packing the second stage regenerative materials 9B in the second stage regenerator tube 10; and (3) inserting the pre-assembled first stage regenerator assembly 3 into the base tube assembly 310.

A two-stage PT cold head may be built based on the embodiment of the two-stage coaxial assembly of a PT cold head depicted in FIG. 4 or based on a variation of the embodiment in FIG. 4, i.e., the embodiment of the two-stage PT assembly having a fixed second stage regenerator tube 10, as depicted in FIG. 7.

Figure 9:
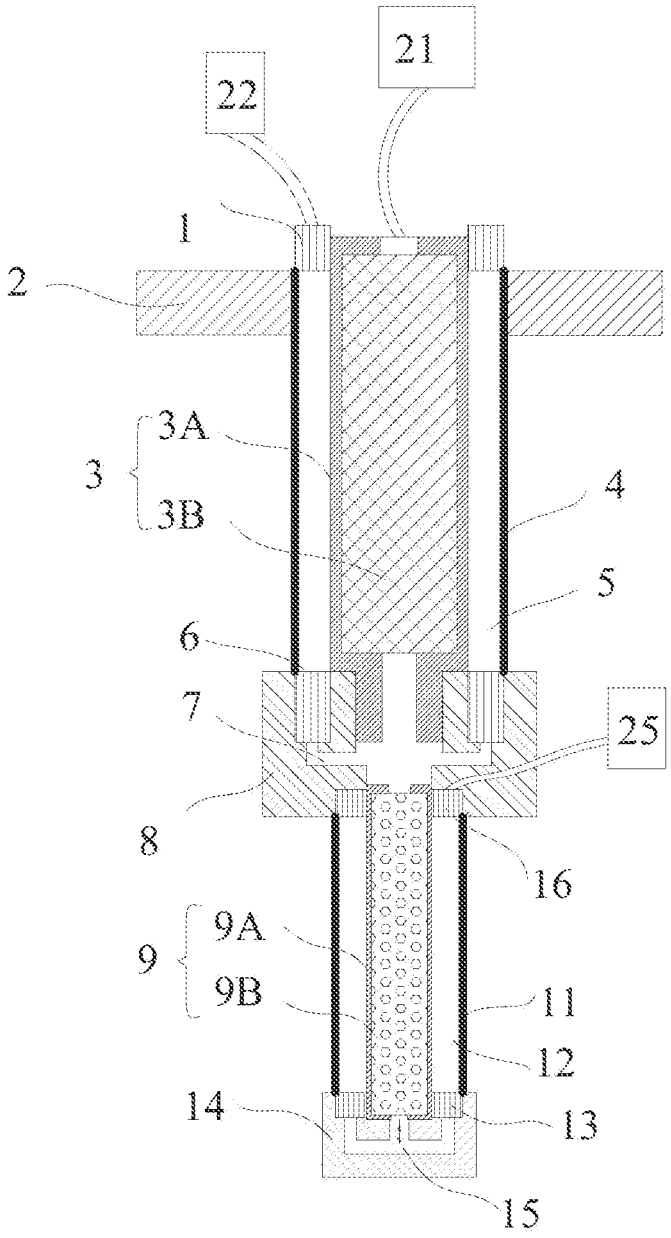
FIG. 9 shows a schematic of an exemplary two-stage PT cold head in accordance with an embodiment of the present teaching based on the embodiment depicted in FIG. 4. According to this version, first and second stage circular regenerator assemblies are surrounded by first and second stage annular pulse tubes, respectively. A warm end of the second stage pulse tube is located in a first stage cooling station. There is no direct flow connection between the two pulse tubes shown.

FIG. 9 shows a schematic of an exemplary coaxial two-stage PT cold head based on the embodiment depicted in FIG. 4. In this specific embodiment, like numbers again refer to like parts for the sake of convenience. The second stage of the PT cold head may be completed as depicted in FIG. 9 by adding a second stage warm heat exchanger 16, a second stage outer tube 11, a second stage heat exchanger 13 and a second stage cooling station 14. The second stage regenerator assembly 9 disposed below and in line with the first stage regenerator assembly 3 according to this embodiment may be located in the center of the second stage outer tube 11. The second stage regenerator assembly 9 consists of the preferably cylindrical regenerator housing 9A housing the regenerative materials 9B. An outer surface of the second stage regenerator assembly 9 and an inner surface of the second stage outer tube 11 form an annular space 12 for the second stage pulse tube. The second stage warm heat exchanger 16 is integrated with the first stage cooling station 8. One end of the warm heat exchanger 16 is connected to a second stage phase shifter, shown schematically as 25. In other embodiments of the coaxial two-stage PT cold head based on the embodiment in FIG. 7, the second stage PT may be completed the same way as previously depicted according to FIG. 9, with the exception of the second stage regenerator assembly 9 consisting of the regenerator housing 9A and regenerative materials 9B being replaced with a fixed second stage regenerator tube 10 hosting the second stage regenerator assembly 9 or hosting the second stage regenerative materials 9B directly.

Operation of the embodiment of the coaxial two-stage PT cold head assembly is described below. The inlet of the first stage regenerator assembly 3 is connected to a pressure wave generator, which provides periodically oscillating pressure to the cold head. In a high-pressure period, the gas flows through the first stage regenerator assembly 3 and splits into two (2) separate flow streams. The regenerator assembly 3 acts as a thermal sponge, alternately absorbing the heat from the passing refrigerant gas and rejecting the absorbed heat back to the refrigerant as the pressure oscillates. One of the flow streams passes through the flow channel 7, the heat exchanger 6, and then into the first stage pulse tube 5. The remaining flow stream flows through the second stage regenerator 9, and then into the second stage pulse tube 12 through a flow channel 15 and the heat exchanger 13. The second stage regenerator 9 may be filled with various regenerative materials for lower temperature operation, such as spheres or meshes of lead and rare earth materials. In a lower pressure period, the refrigerant gas is reversed and expands. Expanded gases from the pulse tubes 5 and 12 pass through the cold heat exchangers 6 and 13 to provide cooling capacities on the first stage cooling station 8 and the second cooling station 14.

Figure 1:
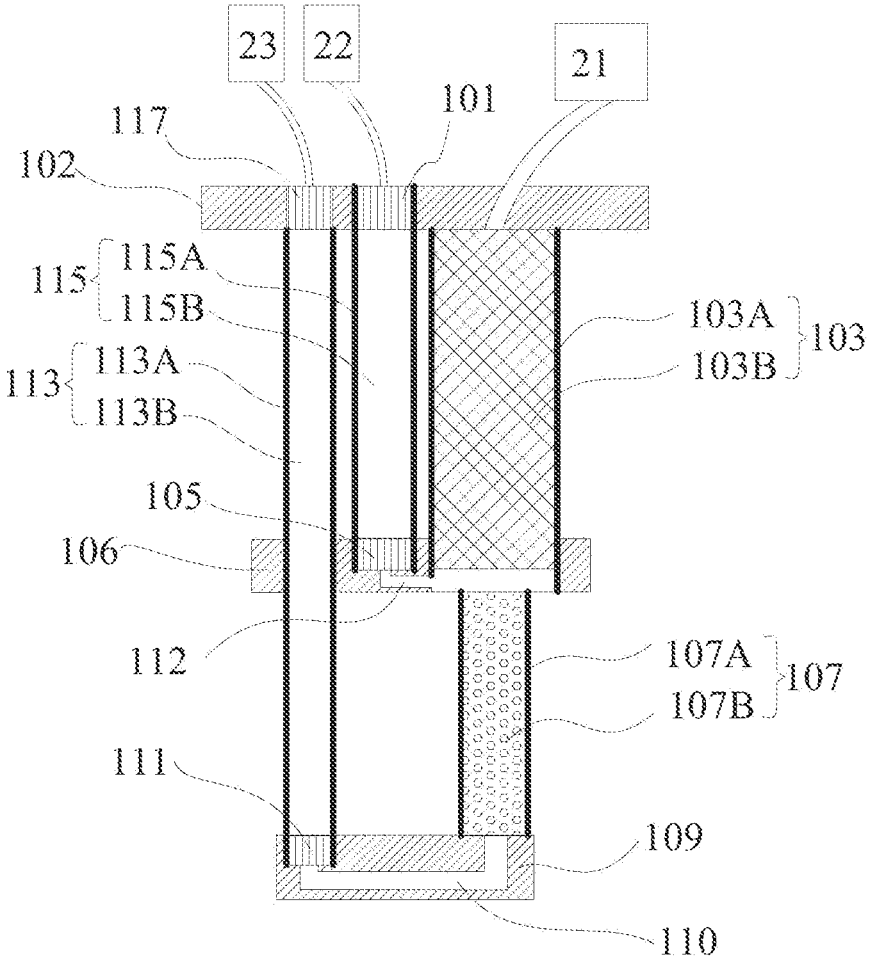
FIG. 1 shows a schematic of a prior art two-stage PT cold head which has a conventional U-type configuration in which the pulse tubes and regenerators are parallel.
Figure 2:
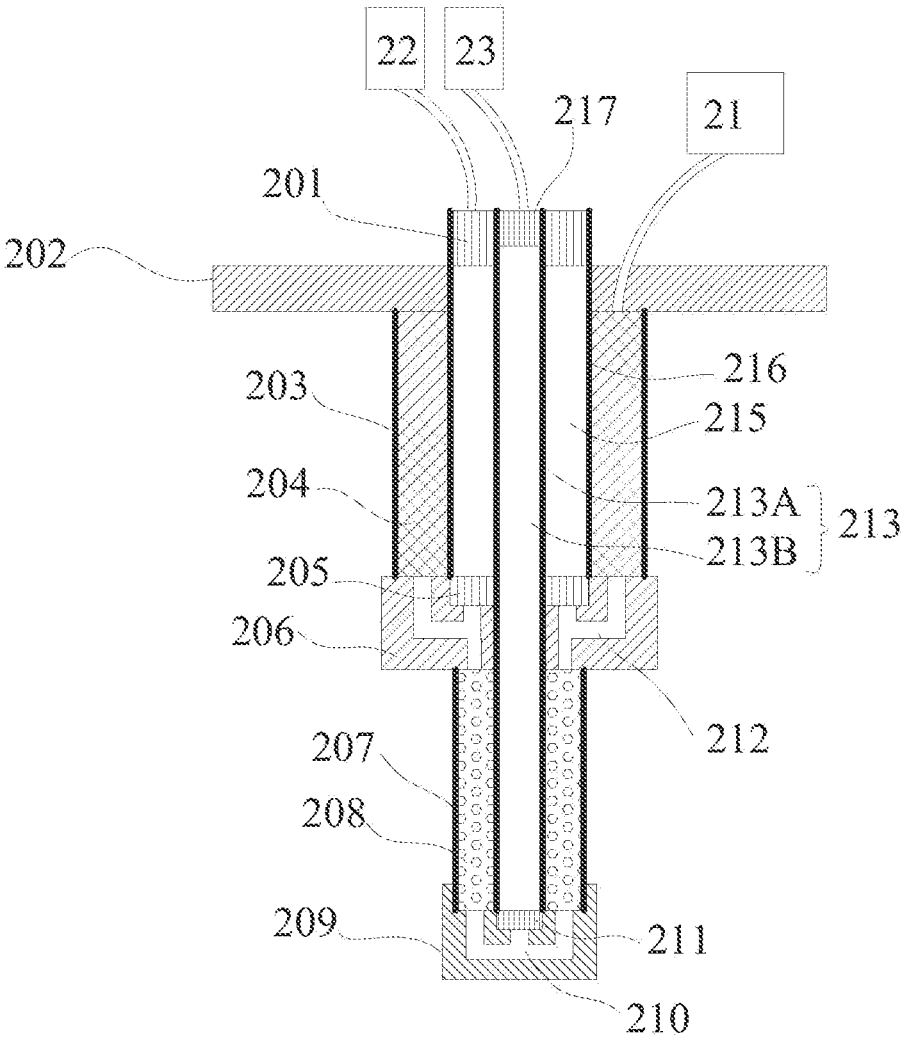
FIG. 2 shows a schematic of a prior art two-stage PT cold head with a coaxial configuration. First stage and second stage circular pulse tubes are located inside of annular regenerators.
Figure 3:
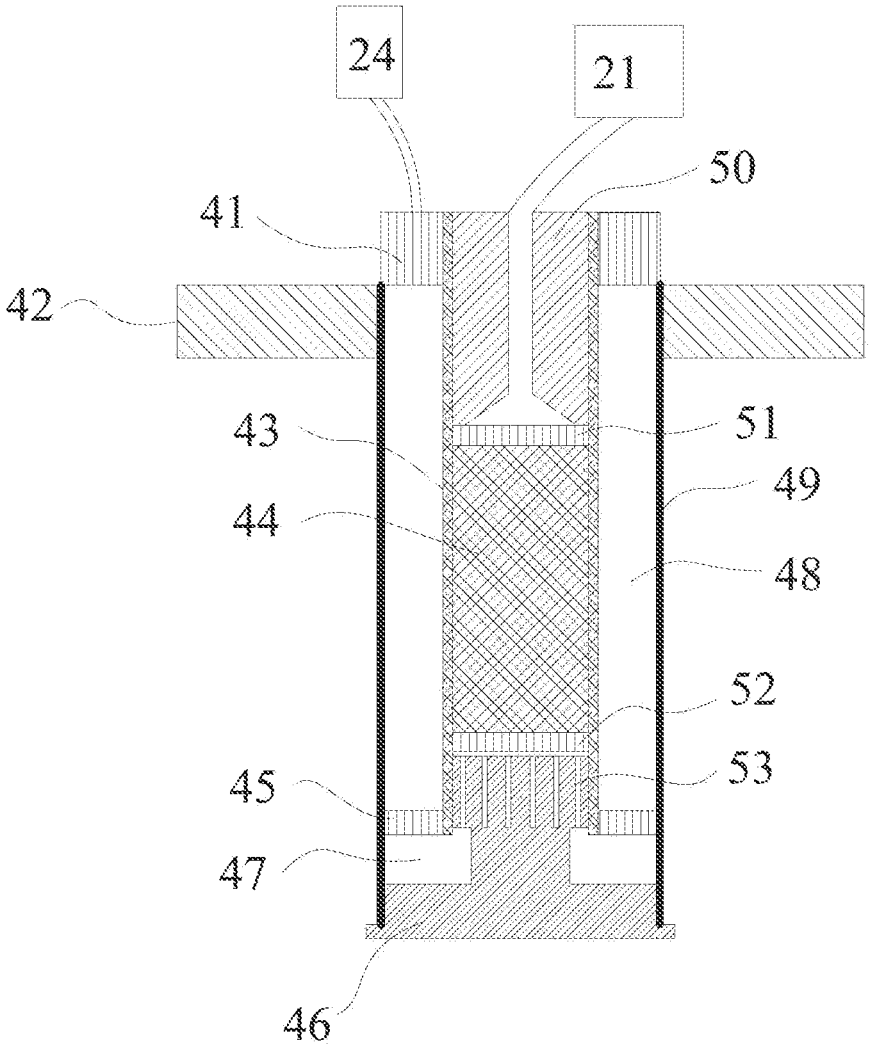
FIG. 3 shows a schematic of a prior art coaxial single-stage PT cold head having a circular regenerator located within an annular pulse tube.

In this embodiment, the second stage pulse tube 12 pumps heat from the second stage cooling station 14 to the first stage cooling station 8, which results in reduction of the first stage cooling capacity. However, the reduced volume of the second stage pulse tube, as compared to the volume of the second stage pulse tube in the prior art cryocoolers shown in FIGS. 1 and 2, may help increase the cooling capacity of the system by increasing the pressure differential in the cold head. The second stage phase shifter located on the first stage cooling station may control the phase shifting more efficiently to obtain better second stage performance. In other embodiments and if the second stage phase shifter uses a double-inlet phase shifter, such as those described by Zhu. S. W., Wu. P. Y. and Chen, Z. Q., "Double inlet pulse tube refrigerators: an important improvement." *Cryogenics*. vol. 30. (1990), pp. 514-520, a controllable orifice between the end of the heat exchanger 16 and the inlet of the second stage regenerator 9 may be added.

Since the two-stage PT cold head illustrated in FIG. 9 is based on the removable regenerator assembly described in FIG. 4, the two-stage PT cold head may be assembled using the processes previously described in FIGS. 5 and 6. In one embodiment, after assembly of the first stage base tube assembly 300 and the second stage base tube assembly, the latter which may include the second stage outer tube 11, the second stage cold heat exchanger 13, the second stage cooling station 14 and the second stage warm heat exchanger 16, in which the pre-assembled second stage regenerator assembly 9 may be inserted into the second stage base tube, and then the first stage regenerator assembly 3 may be inserted into the first stage base tube. In another embodiment, the connected two-stage regenerator assembly 350 may be inserted into the base tubes together.

Higher stages (e.g., three-stage, etc.) with the similar coaxial designs may use the similar assembly process that assemble the base tube of each stage and insert the regenerator assembly of each stage separately or insert the connected multi-stage regenerator assembly into the base tubes together.

Figure 10:
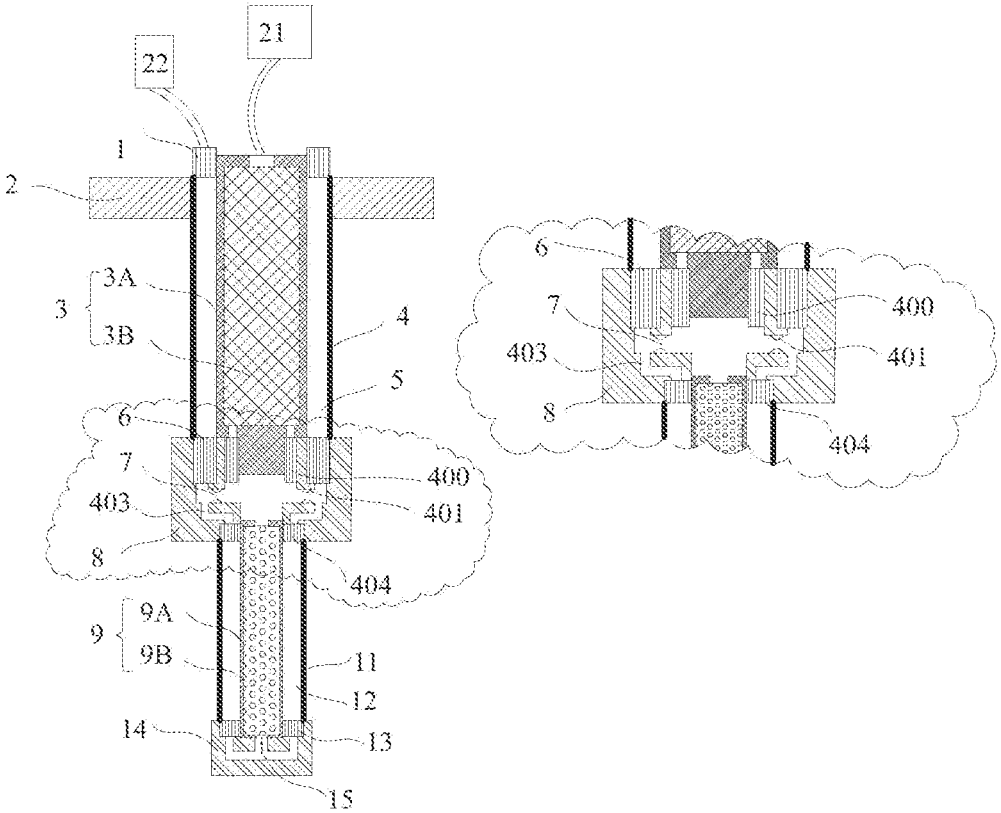
FIG. 10 shows a schematic of an exemplary two-stage PT cold head using a middle-bypass configuration in accordance with another embodiment of the present teaching based on the embodiment depicted in FIG. 4. According to this version, first and second stage circular regenerator assemblies are surrounded by first and second stage annular pulse tubes respectively. There is a flow connection between the first stage pulse tube and the second stage pulse tube.

FIG. 10 shows a schematic of an exemplary two-stage PT cold head using a middle-bypass configuration in accordance with an embodiment of the present teaching and based on the embodiment depicted in FIG. 4. As in the preceding, like numbers refer to like parts for the sake of convenience. In this embodiment, a flow channel 403 may connect a flow straightener 404 at the warm end of the second stage pulse tube 12 and a flow straightener 6 at the cold end of the first stage pulse tube 5, such that the two pulse tubes 5 and 12 can be connected. Alternatively, the flow straighteners 6 and 404 may be eliminated in some practices. A first stage cold heat exchanger 400 may be installed below the first stage regenerator 3. Flow control orifices 401 (which could include a single or multiple orifices) may be installed in the flow channel 7 connecting the first stage regenerator assembly 3 and the first stage pulse tube 5 to form a first stage cooling loop. According to this embodiment, the first stage gas flow through the flow channel 7 can be controlled by the orifices 401 to obtain the desired flow rate for the refrigeration.

Applicant has done theoretical analysis and experimental testing as described in the paper entitled "Numerical analysis and experimental verification of multi-bypass pulse tube refrigerators, In: Advances in Cryogenic Engineering (1996), Vol. 41B, pp. 1389-1394", herein incorporated by reference. As a result, it has been revealed that middle-bypass flow at the flow channel 7 could generate cooling effects. In the embodiment of the present teaching, the middle-bypass (the flow channel 7 and the flow control orifice 401) may be used to build up the first stage of the two-stage PT cold head.

Operation of this embodiment of the two-stage PT cold head is described below. The inlet of the first stage regenerator assembly 3 is connected to a pressure wave generator, the latter which provides periodically oscillating pressure to the cold head. In a high-pressure period, the gas flows through the first stage regenerator assembly 3, the heat exchanger 400 and splits into two (2) separate flow streams. One of the flow streams passes through the flow control orifices 401 into the first stage pulse tube 5. The remaining flow stream flows through the second stage regenerator 9, and then into the second stage pulse tube 12 through a flow channel 15 and a heat exchanger 13.

In the low-pressure period (expansion period) of a cycle, the gas flows in reverse. That is, the expansion gas from the first stage pulse tube 5 flows through the flow control orifice 401 and the heat exchanger 400. The heat exchanger 400 adsorbs the cooling capacity generated by the expansion gas in the first stage pulse tube 5. The cold heat exchanger 400 thermally contacts the first stage cooling station 8 to provide first stage cooling. The expansion gases from the pulse tube 12 pass through the cold heat exchanger 13 to provide the cooling capacities on the second cooling station 14.

In other practices of the present teaching for the embodiment in FIG. 10, the first stage heat exchanger 400 and the flow control orifice(s) 401 may be located between the two regenerator assemblies 3 and 9 so that these components can be installed and removed in like manner as the regenerator assemblies. The components may be assembled in the order of the second stage regenerator assembly 9, the flow control orifice 401, the first stage heat exchanger 400 and the first stage regenerator assembly 3. It will be understood that other practices of freely grouping the above components together may be done for installation.

The embodiment in FIG. 10 may lose some efficiencies of the cryocooler since the second stage pulse tube rejects the heat to the first stage, and the first stage and second stage share the same phase shifter, shown schematically as 22 located at room temperature. However, this embodiment reduces the number of components in the cold head and is easy to build. Moreover, the herein described embodiments of the present invention simplifies the manufacturing process, reduces the cost of the cold head and also reduces the vibration of the cold head. It can be used in applications that require extremely low vibrations and lower cost.

Figure 11:
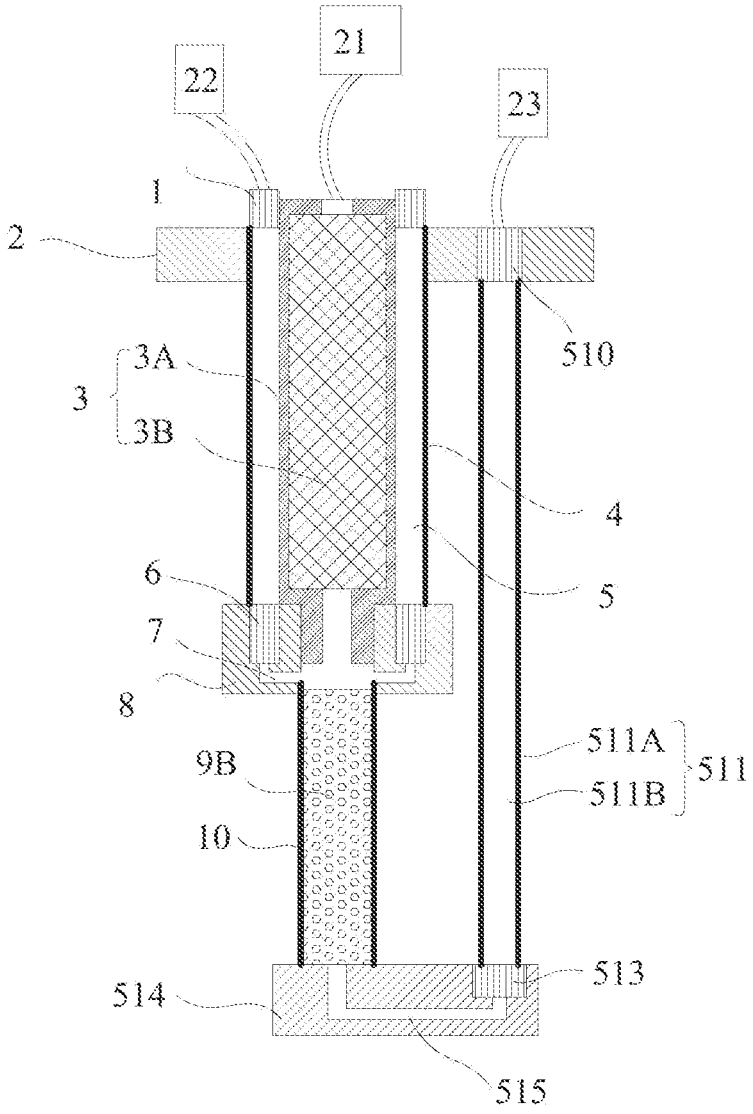
FIG. 11 shows a schematic of an exemplary hybrid two-stage PT cold head having a coaxial $1^{st}$ stage and a U-type parallel second stage made in accordance with an embodiment of the present teaching. Second stage regenerative materials may be directly packed in a regenerator tube.

FIG. 11 shows a schematic of an exemplary hybrid two-stage PT cold head in accordance with an embodiment of the present teaching based on the embodiment depicted in FIG. 7. This teaching compromises the manufacturing simplicity and cryocooler efficiency. In this embodiment and as in the preceding, like numbers refer to like parts for the first stage depicted in FIG. 7. The second stage employs a conventional parallel arrangement for the regenerator tube 10 and the pulse tube 511. The second stage circular pulse tube 511 according to this embodiment consists of a tube 511A and a pulse tube space 511B. The second stage regenerative materials 9B may be directly packed within the second stage regenerator tube 10, which is made of low heat conductive metal materials, e.g., stainless steel. The cold end of the second stage pulse tube 511 connects to the cold end of the second stage regenerator though a second stage heat exchanger 513 and a flow channel 515. The second stage heat exchanger 513 thermally contacts a second stage cooling station 514 to provide the required cooling. The warm end of the second stage pulse tube 511 connects to a room temperature heat exchanger 510. In this embodiment, the second stage pulse tube 511 pumps heat from the second stage cooling station 514 to the room temperature heat exchanger 510 without interrupting the first stage cooling. The first stage and second stage room temperature heat exchangers 1 and 510 connect to phase shifters shown schematically as 22 and 23, respectively.

Figure 12:
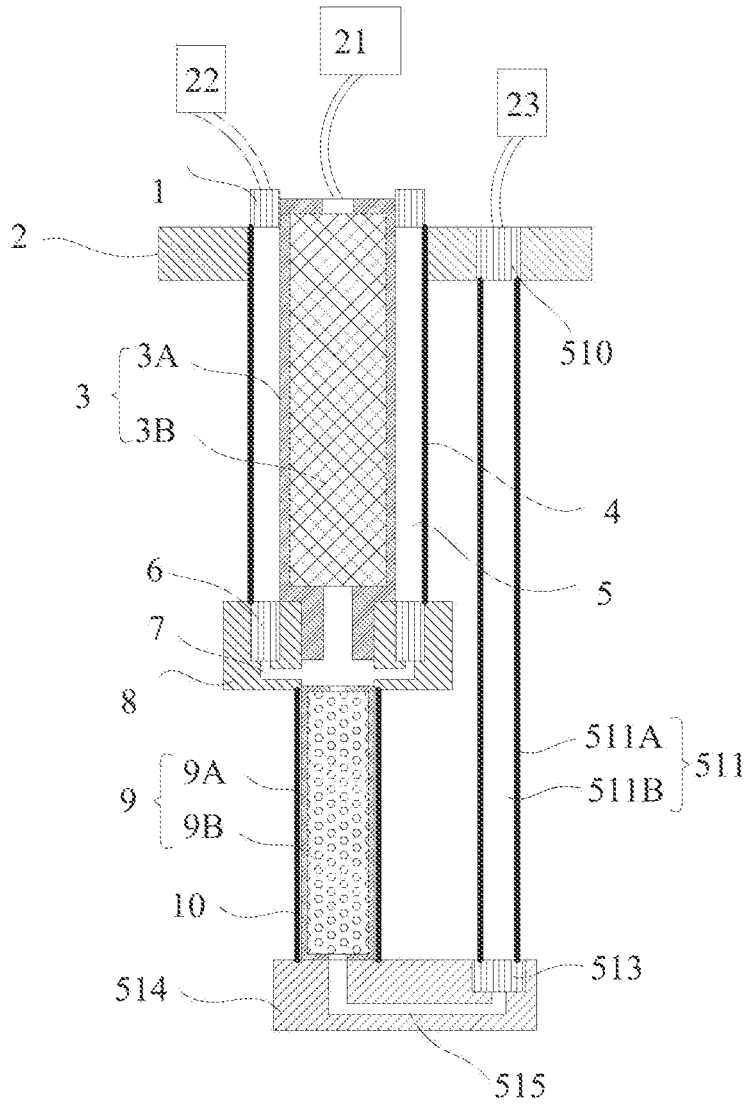
FIG. 12 shows a schematic of an exemplary hybrid two-stage PT cold head having a removable $2^{nd}$ stage regenerator assembly made in accordance with another embodiment of the present teaching, and more specifically a variation of the embodiment depicted in FIG. 11.

FIG. 12 shows a variation of the embodiment in FIG. 11 with a removable second stage regenerator assembly 9. As in the preceding, like numbers refer to like parts for the sake of convenience. According to this embodiment, the second stage regenerator consist of the second stage regenerator tube 10 and second stage regenerator assembly 9. The second stage regenerator assembly 9, including the second stage regenerator housing 9A and second stage materials 9B, may be pre-assembled and inserted in the second stage regenerator tube 10. In this embodiment, both the first and second stage regenerator assemblies 3 and 9 are removable.

Figure 13:
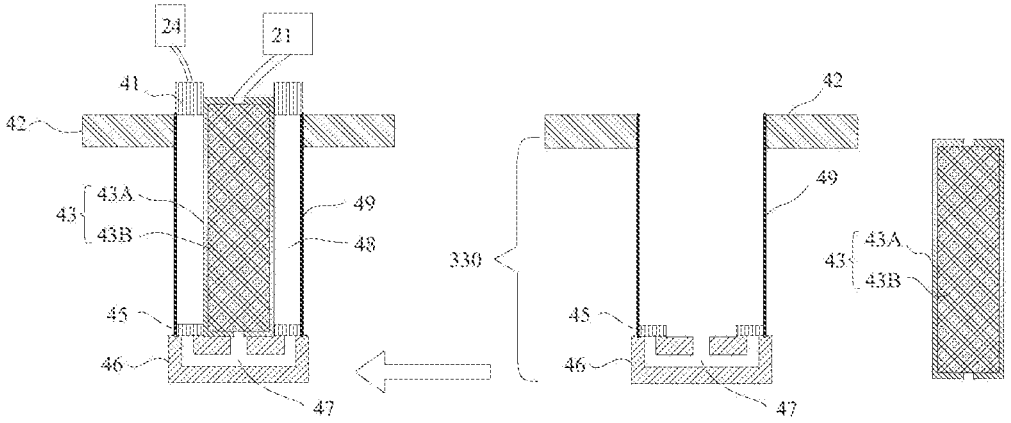
FIG. 13 shows schematics of an exemplary regenerator assembly and base tube assembly and an assembled single-stage PT cold head, each made in accordance with another embodiment of the present teaching.

The previously described processes used to build and assemble the two-stage PT cold head can also be used for manufacturing the single-stage PT cold head. FIG. 13 shows the schematics of the exemplary sub-assemblies of a base tube assembly 330 and a regenerator assembly 43, as well as the assembled cold head. The base tube assembly 330 in FIG. 13 may include a room temperature flange 42, outer tube 49, flow straightener/cold heat exchanger 45 and cooling station 46. The regenerator assembly 43 in FIG. 13 includes the regenerator housing 43A and the regenerative materials 43B. The regenerator assembly 43 may be inserted into the base tube assembly 330 to form an annular pulse tube space 48, thus, completing the PT cold head.

The advantages of the present teaching include the simplification of the process for building the PT cold head, and the reduction of its vibration and manufacture cost with the coaxial design. Although the present teaching has been described with certain specific embodiments for instructional purposes, the present teaching is not limited thereto. Accordingly, various modifications, adaptations and combinations of various features of the described embodiments can be practiced without departing from the scope of teaching as set forth in the claims.

What is claimed is:

1. A two-stage PT cryocooler cold head assembly, comprising:

a co-axial first stage comprising:

a first stage circular regenerator assembly centrally located in a first stage outer tube; and the first stage pulse tube, in which an annular space defining the first stage pulse tube is formed by an outer surface of the first stage regenerator assembly and an inner surface of the outer tube; and a second stage including a second stage circular regenerator installed below the first stage regenerator assembly.

2. The two-stage PT cryocooler cold head assembly of claim 1, wherein the second stage regenerator comprises:

a removable second stage circular regenerator assembly including a second stage regenerator housing and second stage regenerative materials, in which the second stage regenerator assembly is inserted below and in line or offset with the first stage regenerator assembly.

3. The two-stage PT cold head assembly of claim 1, wherein the second stage regenerator comprises a second stage regenerator assembly having a stationary second stage regenerator tube and second stage regenerator materials and in which the regenerator materials being packed directly into the second stage regenerator tube.

4. The two-stage PT cold head assembly of claim 1, wherein the second stage is coaxial with the first stage, the second stage comprising:

a second stage circular regenerator assembly located in the center of a second stage outer tube;

the second stage pulse tube in which an annular space of the second stage pulse tube formed by an outside surface of the second stage regenerator assembly and an inner surface of the second stage outer tube with no direct gas flow connection/channel between the first and second stage pulse tubes;

a second stage warm heat exchanger, located in a first stage cooling station and connected to a warm end of the second stage pulse tube;

a second stage phase shifter connected to an end of the second stage warm heat exchanger; and a second stage cold heat exchanger located between a cold end of the second stage pulse tube and the second stage regenerator.

5. The two-stage PT cold head assembly of claim 4, wherein the first and second stage regenerator assemblies are removable and may be pre-assembled as one of a combined assembly or as separate subassemblies, wherein the first stage regenerator assembly includes a first stage regenerator housing and regenerative materials packed in the first stage regenerator housing, and the second stage regenerator assembly includes a second stage regenerator housing and regenerative materials packed in the second stage regenerator housing; and in which the annular spaces for the each of the first and second stage pulse tubes are formed by inserting the first and second stage regenerator assemblies in a base tube assembly.

6. The two-stage PT cold head assembly of claim 2, further comprising:

a stationary second stage regenerator tube that houses the second stage regenerator assembly;

a second stage circular pulse tube with a cold end connected to a second stage cold heat exchanger in a second stage cooling station and a warm end connected to a second stage warm heat exchanger located at room temperature; and a second stage cooling station with an internal flow channel connecting cold ends of the second stage regenerator and pulse tube through a cold heat exchanger, where the second stage regenerator and pulse tube are parallel.

7. The two-stage PT cold head assembly of claim 6, wherein the first and second stage regenerator assemblies are removable, and the annular space of the first stage pulse tube is formed by inserting the first stage regenerator assembly into the base tube assembly.

8. The two-stage PT cold head assembly of claim 3, further comprising:

a second stage circular pulse tube with a cold end connected to a second stage cold heat exchanger in a second stage cooling station and a warm end connected to a second stage warm heat exchanger located at room temperature; and a second stage cooling station with an internal flow channel connecting cold ends of the second stage regenerator and second stage pulse tube through a cold heat exchanger, where the second stage regenerator and second stage pulse tube are parallel.

9. The two-stage PT cold head assembly of claim 8, wherein the first stage regenerator assembly is pre-assembled as a subassembly including the first stage regenerator housing and the regenerative materials, wherein the first stage pulse tube is formed by inserting the first stage regenerator assembly.

10. The two-stage PT cold head assembly of claim 1, further comprising:

a coaxial second stage comprising:

the second stage circular regenerator assembly located in the center of a second stage outer tube;

wherein an annular space of the second stage pulse tube is formed by an outer surface of the second stage regenerator assembly and an inner surface of the second stage outer tube;

a flow channel connecting a warm end of the first stage pulse tube and a cold end of the second stage pulse tube;

a first stage heat exchanger installed below the first stage regenerator assembly;

a flow channel connecting the first stage heat exchanger and the first stage pulse tube;

at least one flow control orifice added in the flow channel connecting the first stage heat exchanger and the first stage pulse tube; and a cold heat exchanger/flow straightener located between the cold ends of the second stage pulse tube and the second stage regenerator assembly.

11. The two-stage PT cold head assembly of claim 10, further comprising:

first and second stage regenerator assemblies each pre-assembled as one of a completed assembly or as separate subassemblies, wherein the first stage regenerator assembly includes a first stage regenerator housing and regenerative materials packed in the first stage regenerator housing, and the second stage regenerator assembly includes a second stage regenerator housing and regenerative materials packed in the second stage regenerator housing; and annular spaces of the first and second stage pulse tubes being formed by inserting the first and second stage regenerator assemblies into the base tube assembly.

12. The two-stage PT cryocooler cold-head assembly of claim 2, in which the amount of offset between the first stage regenerator assembly and the second stage regenerator assembly is small enough to permit the second stage circular regenerator to pass through the annular space of the outer tube of the first stage during installation.

* * * * *